US005441065A

United States Patent [19]

Lin et al.

[11] Patent Number: 5,441,065

[45] Date of Patent: Aug. 15, 1995

[54] MULTIPLE-FOLD AUTOMATIC UMBRELLA FOR SAFE OPERATION

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 370,411

[22] Filed: Jan. 9, 1995

Related U.S. Application Data

[63] Continuation-in-part of Ser. No. 148,621, Nov. 3, 1993.

[51] Int. Cl.[6] ..... A45B 25/14

[52] U.S. Cl. ..... 135/24; 135/20.3; 135/25.4

[58] Field of Search ..... 135/22–24, 135/20.3, 25.1, 25.4, 25.41, 37, 38, 39, 40

[56] References Cited

U.S. PATENT DOCUMENTS 4,823,821 4/1989 Day ..... 135/24
4,936,332 6/1990 Wu ..... 135/24 X
4,941,494 7/1990 Wu ..... 135/24 X
4,989,625 2/1991 Wu ..... 135/24 X
5,178,174 1/1993 Wu ..... 135/24 X
5,390,686 2/1995 Lin et al. ..... 135/20.3 X

*Primary Examiner*—Lanna Mai

[57] ABSTRACT

An automatic umbrella includes: a central shaft, a rib assembly for securing an umbrella cloth thereon, an opening spring for resiliently opening the umbrella, a plurality of closing springs for resiliently closing the umbrella, and a control device for controlling the opening or closing of the umbrella by depressing an upper portion or a lower portion of a push button of the control device with the control device including an anti-false operation safety device having a pair of lugs protruding downwardly from a collar resiliently held in a grip of the central shaft for normally shielding a depression of the lower portion of the push button for preventing an unexpected closing operation of an umbrella which is not fully opened after depressing the upper portion of the push button.

12 Claims, 5 Drawing Sheets

MULTIPLE-FOLD AUTOMATIC UMBRELLA FOR SAFE OPERATION

This application is a continuation-in-part (C-I-P) application of the U.S.A. patent application (hereinafter called "original application") entitled "Multiple-fold Automatic Umbrellla" filed on: Nov. 3, 1993, with Ser. No. 08/148,621, by the same inventors of this application.

BACKGROUND OF THE INVENTION

Original application discloses a seesaw button of the control means 5 for opening or closing the umbrella. However, there is not provided with any safety device for preventing a false depression of the lower button portion 513 of the seesaw button, whereby when depressing the upper button portion 512 of the seesaw button for opening the umbrella and when the umbrella is not yet fully opened, a further depression of the lower button portion 513 will suddenly close the umbrella and release the spring energy of the opening spring 3 to possibly eject the central shaft means 1 to cause unexpected accidental injury to a user or nearby person. Meanwhile, the long drag rope 56 is flexible, windable and foldable within the telescopic tubes of the central shaft means 1 and will be easily tangled in the hollow central shaft means, thereby influencing a smooth operation of the umbrella.

SUMMARY OF THE INVENTION

The object of the present invention is to provide an anti-false operation safety device for preventing depression of a lower portion of a push button of the control device for preventing unexpected closing operation when opening the umbrella; a drag rod coupled to a drag rope for preventing tangling of the control device; and other modifications for the improvement of the automatic umbrella of the original application including: a central shaft, a rib assembly for securing an umbrella cloth thereon, an opening spring stored with elastic energy for opening the umbrella, a plurality of closing springs with pre-stored elastic energy for closing the umbrella, and the control device for controlling the opening or closing of the umbrella by depressing an upper portion or a lower portion of the push button of the control device.

DETAILED DESCRIPTION

Figures 1, 1A:
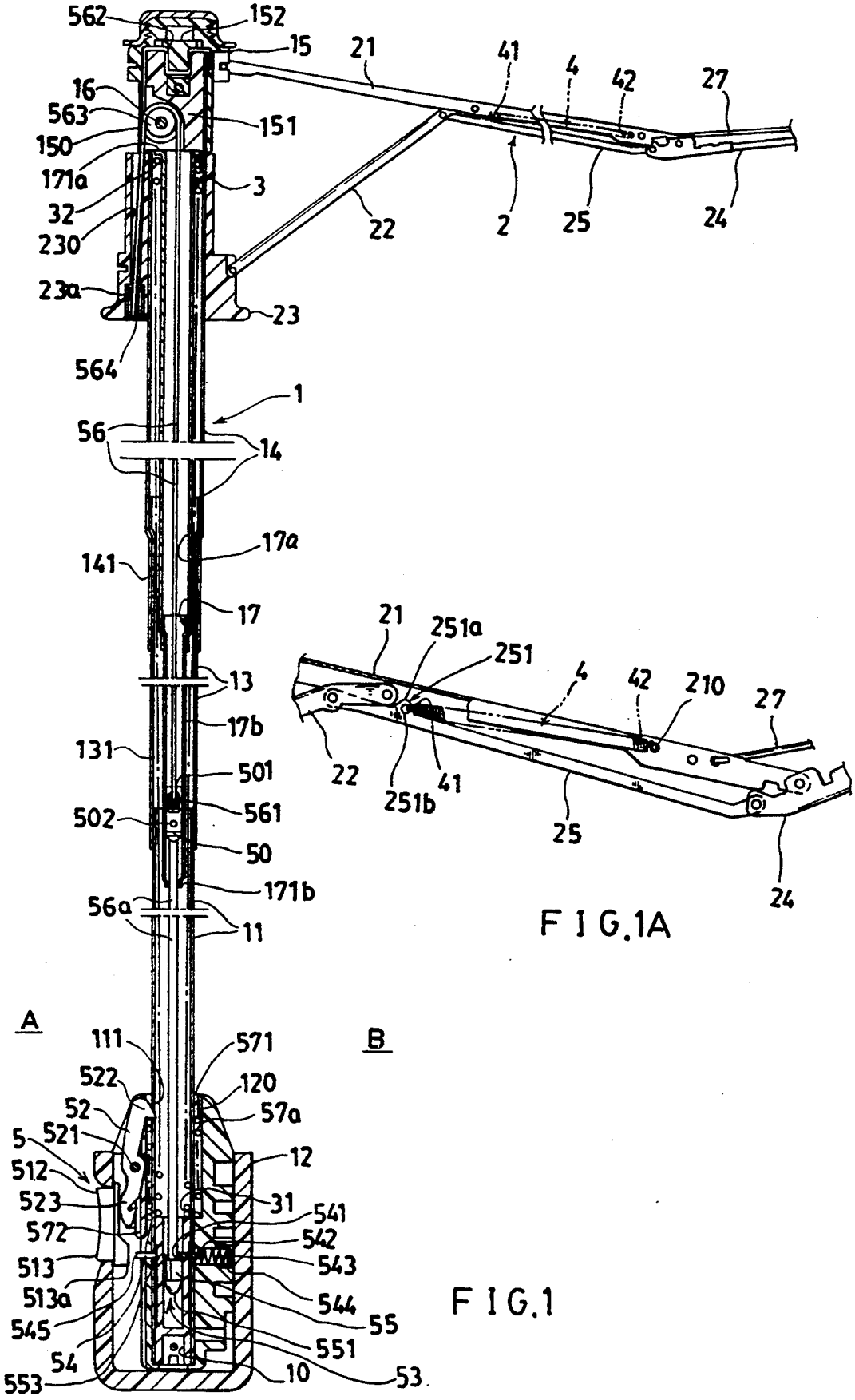
FIG. 1 is an illustration showing an opened umbrella in accordance with the present invention.
FIG. 1A is a partial enlarged illustration of a closing umbrella and the ribs of the present invention.
Figure 3:
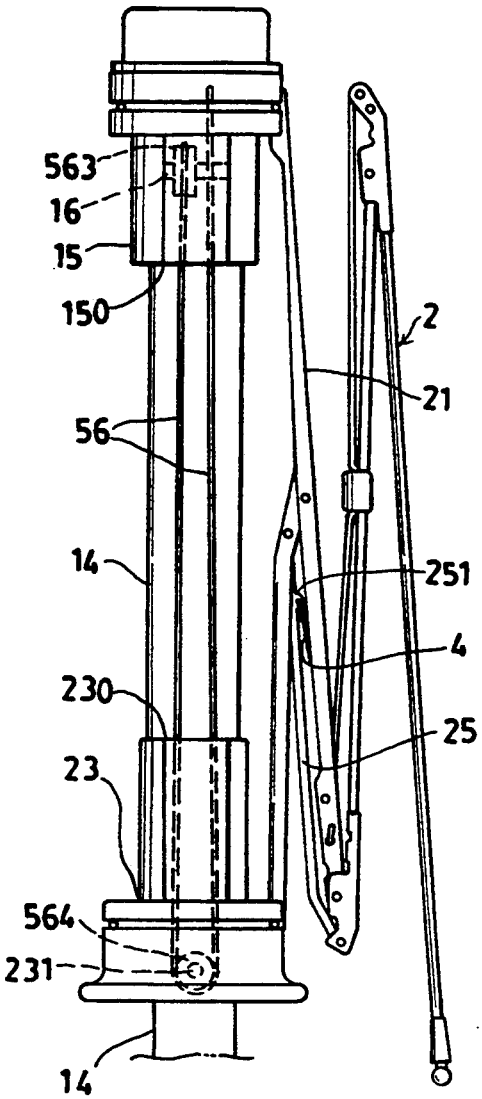
FIG. 3 is a partial illustration of the closed umbrella as shown in FIG. 2.

As shown in the drawing figures, the present invention comprises: a central shaft means 1, a rib assembly 2, an opening spring 3, a plurality of closing springs 4, and a control means 5.

The central shaft means 1 includes: an inner (or lower) tube 11, a grip 12 having a lower tube portion of the inner tube 11 fixed in a central portion of the grip 12, a lower sleeve 10 inserted in a central lower portion of the grip 12, a middle tube 13 slidably held on an outer and upper side of the inner tube 11, an outer (or upper) tube 14 slidably held on an outer and upper side of the middle tube 13, an upper notch 15 secured on a top portion of the outer tube 14, and a central sleeve set 17 including an inner sleeve section **17*b*, and an outer sleeve section 17*a* telescopically coupled with the inner sleeve section 17*b* having an uppermost sleeve portion 171*a* of the outer sleeve section 17*a* contiguous to an upper portion of the outer tube 14**.

The rib assembly 2 includes: a top rib 21 having an inner rib portion of the top rib 21 pivotally secured to the upper notch 15 of the central shaft means 1, an inner stretcher rib 22 having an inner rib portion of the inner stretcher rib 22 pivotally secured to a lower runner 23 which is slidably held on the outer tube 14 and having an outermost rib end of the inner stretcher rib 22 pivotally connected with a middle portion of the top rib 21, an intermediate rib 24 having an inner rib end of the intermediate rib 24 pivotally connected with an outermost rib end of the top rib 21 and having an innermost rib end of the intermediate rib 24 pivotally connected with an intermediate connecting rod 25 of which an inner rod end of the intermediate connecting rod 25 is pivotally secured to an outer rib portion of the inner stretcher rib 22, and a rear rib 26 having an inner rib portion of the rear rib 26 pivotally connected with an outer rib portion of the intermediate rib 24 and having an innermost rib end of the rear rib 26 pivotally connected with a spring rod 27 of which an inner rod end of the spring rod 27 is pivotally connected with an outer rib portion of the top rib 21. The intermediate connecting rod 25 may be made as a thin plate.

The opening spring 3 for opening an umbrella of this invention has a lower spring end 31 retained on an upper edge portion of the lower sleeve 10, and an upper spring end 32 retained on a bottom portion of an inner block 151 inserted in an upper portion of the outer tube 14, the opening spring 3 slidably disposed about the central sleeve set 17.

Each closing spring 4 of the plurality of the closing springs 4 is received into a longitudinal groove recessed in the top rib 21 and has an inner spring end 41 of the closing spring 4 secured to an inner connection portion 251 of the intermediate connecting rod 25 having a projection **251*a* protruding towards the top rib 21 and a hook hole 251*b* eccentrically notched in the projection 251*a* for engaging the inner spring end 41 made as a hook, and an outer spring end 42 of the closing spring 4 secured to an outer rib portion of the top rib 21 by a pin 210 as shown in FIG. 1A. The closing spring 4** is provided for operatively closing an umbrella from its opened state by an elastic energy stored when opening the umbrella.

The control means 5 includes: a push button 51 resiliently held in a button hole **120*a* in the grip 12, an opening lever 52 pivotally mounted in an upper portion of the grip 12 and operatively depressed by an upper button portion 512 of the push button 51 for opening the umbrella, a closing controller 53 operatively depressible by a depression block 513***a* formed inside a lower button portion 513 of the push button 51 for disengaging a locking head 55, which is secured with a drag rod 56*a* coupled to a drag rope 56 which is linked through the lower runner 23 to an upper portion of the outer tube 14, from a sliding latch 54 slidably held in the grip 12, thereby allowing each said closing spring 4 to be restored to release its pre-stored elastic energy for closing the umbrella from an opened state, and an anti-false operation safety means 57 normally shielding the closing controller 53 to prevent a false operation to depress the closing controller 53 before fully opening the umbrella.

The opening lever 52 includes a lever pivot 521 for pivotally mounting the opening lever 52 in the grip 12, a hook portion 522 formed on an upper portion of the opening lever 52 engageable with a hook hole 141 formed in the outer tube 14, a hook hole 131 formed in the middle tube 13 and a hook hole 111 in the inner tube 11 for locking an umbrella under a closed state, and a depression portion 523 formed on a lower portion of the opening lever 52 and resiliently held by a lever spring 524 retained in the grip to be operatively depressed by the upper button portion 512 of the push button 51 for disengaging the hook portion 522 from the hook holes 141, 131, 111 of the outer, middle and inner tubes 14, 13, 11 for opening the umbrella as resiliently tensioned by the opening spring 3. The lever spring 524 also resiliently urges the push button 51 outwardly to allow a shoulder portion 514 of the button 51 to be normally retained on a periphery of the button hole 120*a* of the grip 12.

The closing controller 53 as shown in FIGS. 5–8 includes: the sliding latch 54 having a tongue portion 541 engageable with the locking head 55 secured with the drag rod 56*a*, a pair of arm members 545 bifurcated from the tongue portion 541 and protruding forwardly towards the push button 51 at a first side A of the central shaft means 1 to be operatively depressed by the depression block 513*a* formed inside the lower button portion 513 of the push button 51 for closing an umbrella from an opened state, a latch spring 543 jacketed on a stem 542 protruding rearwardly from the tongue portion 541 towards a second side B of the shaft means 1 to be resiliently retained on a plug 544 inserted in the grip 12 adjacent to the second side B of the shaft means 1 for normally urging the sliding latch 54 forwardly to be operatively depressed by the depression block 513*a* formed inside the lower button portion 513 of the push button 51.

Figure 7:
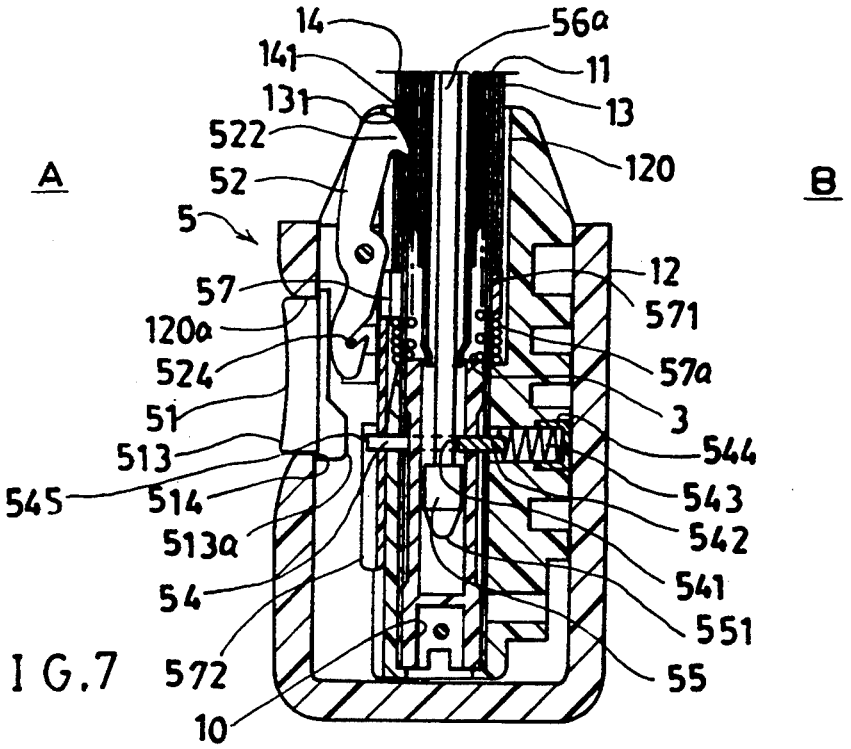
FIG. 7 is a sectional drawing of the control means and the grip of the present invention.
Figure 8:
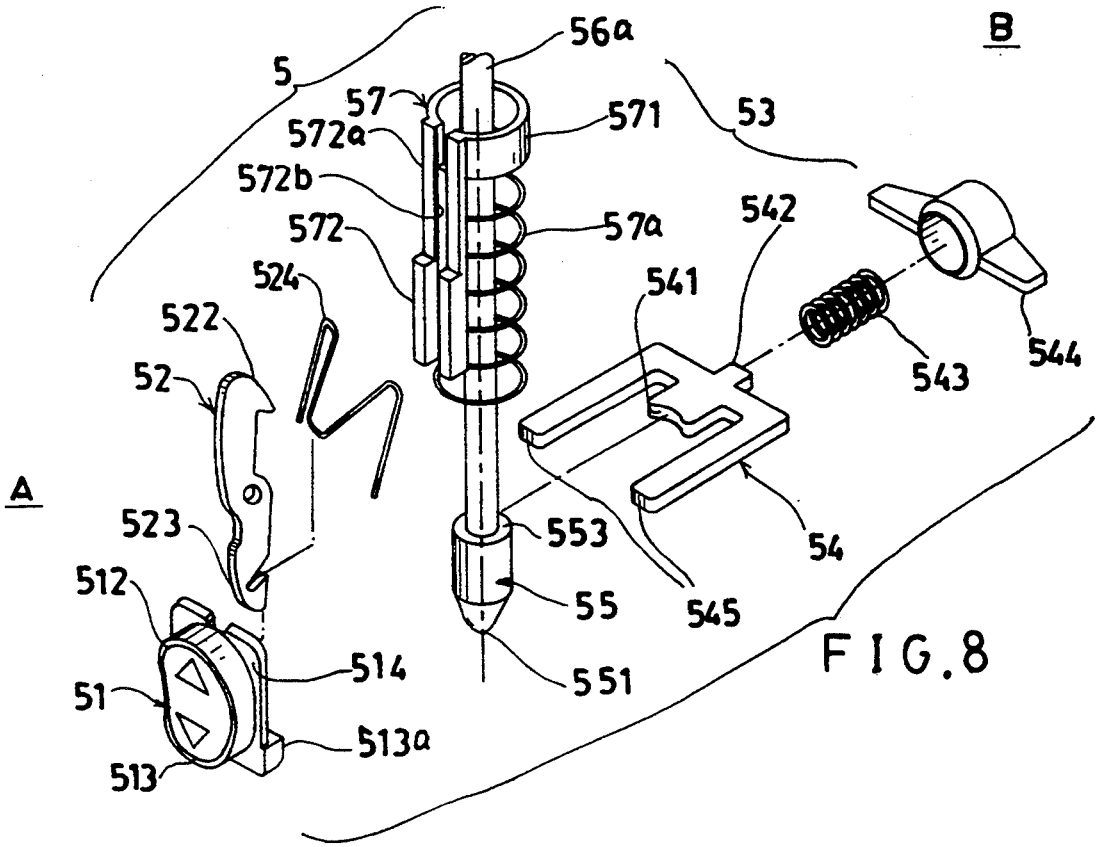
FIG. 8 is an exploded view showing the elements of the control means of the present invention.

The locking head 55 generally cylindrical shaped includes: a bottom ball portion 551 formed on a bottom portion of the locking head 55, and an annular shoulder portion 553 formed on an upper portion of the locking head 55 for engaging the tongue portion 541 of the sliding latch 54. The locking head 55 is downwardly rested on the lower sleeve 10 to be locked by the latch 54 as shown in FIG. 1 or 7.

Figure 4:
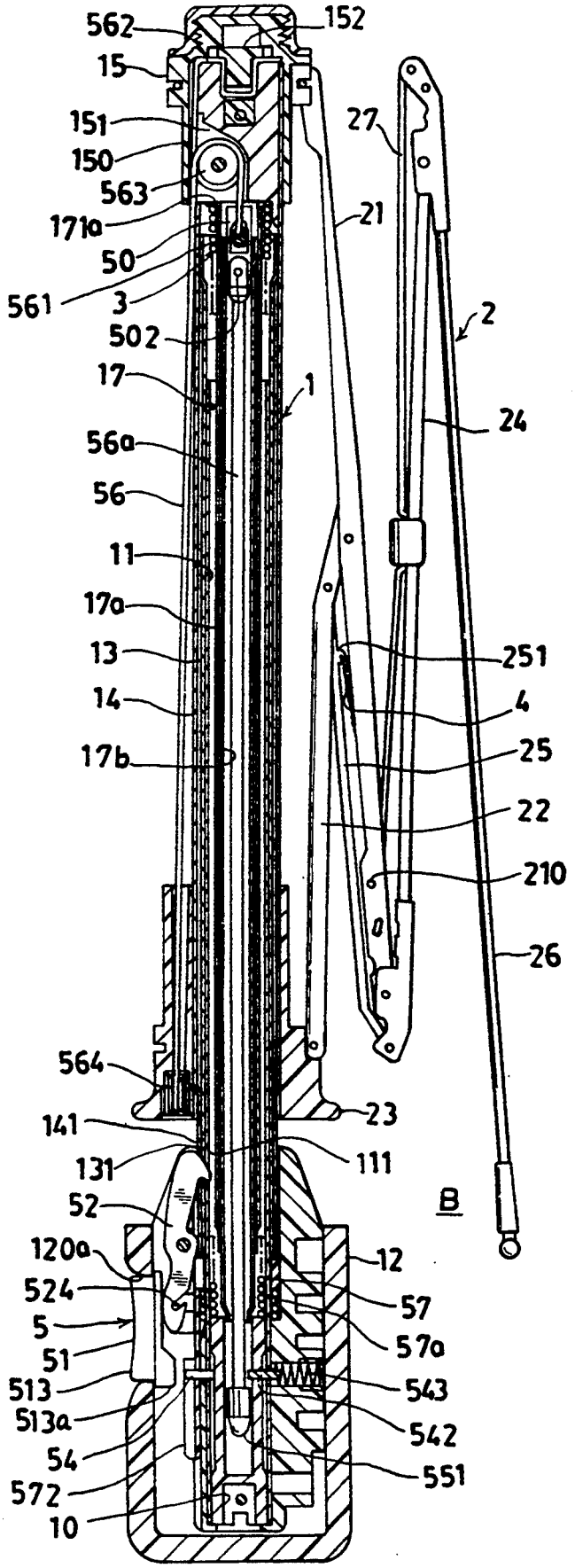
FIG. 4 shows a shortened folded umbrella after being re-set for pre-storing a spring energy of the umbrella ready for a next opening use.

The drag rod 56*a* has a lower rod end secured to the locking head 55 and an upper rod end coupled to a drag rope 56 by a coupling member 50, with the drag rod 56*a* slidably held in the inner sleeve section 17*b* of the central sleeve set 17 and having a length of the drag rod 56*a* generally equal to a length of a folded central shaft means 1 when closing the umbrella as shown in FIG. 4.

The coupling member 50 is secured with an upper rod end of the drag rod 56*a* by a pin 502 and is formed with a rope cavity 501 in an upper portion of the coupling member 50 for securing a lower rope end 561 of the drag rope 56 in the rope cavity 501. The coupling member 50 is limited by a shrunk lower sleeve end 171*b* of the inner sleeve section 17*b* when opening the umbrella as shown in FIG. 1.

The drag rope 56 includes: the lower rope end 561 secured to the drag rod 56*a* through the coupling member 50, an upper rope end 562 fixed to a top portion 152 of the outer tube 14 and in the upper notch 15, an upper guiding roller 563 rotatably mounted by a upper pivot 16 in the inner block 151 secured in a top portion of the outer tube 14 and in the upper notch 15 for slidably guiding the drag rope 56 from inside the outer tube 14 and the central sleeve set 17 telescopically held within the inner tube 11, the middle tube 13, and the outer tube 14 through the upper guiding roller 563 towards a lower guiding roller 564 through a rope passage 150 formed in the upper notch 15, the rope 56 with an upper rope section passing through the lower guiding roller 564 to have the upper rope end 562 fixed to the top portion 152 of the outer tube 14 and inside the inner block 151. The rope 56 and the rod 56a provide a stroke for telescopically operating the tubes of the central shaft means 1 and the runner 23.

Figure 5:
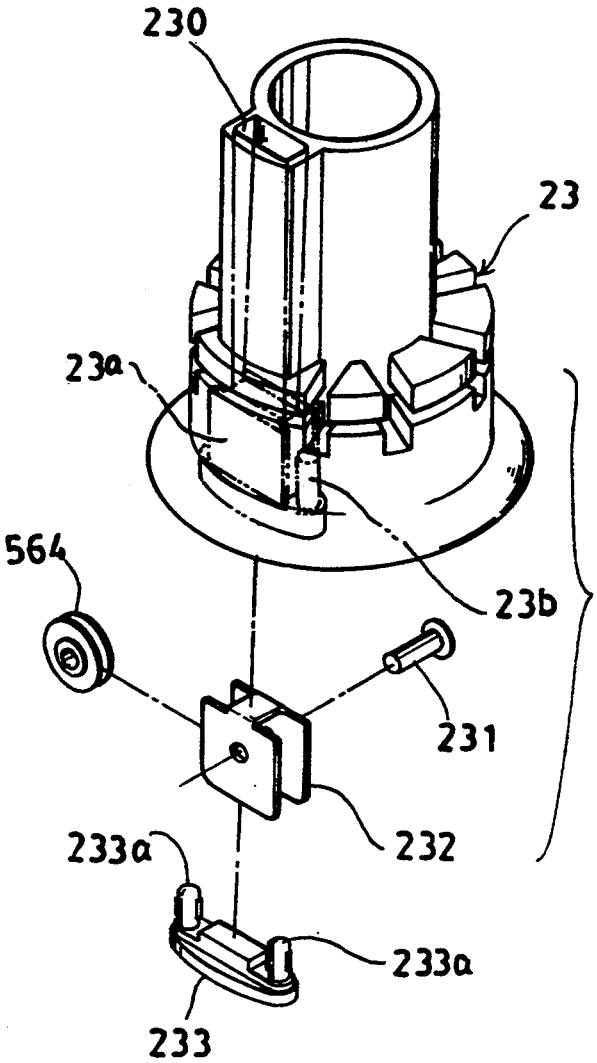
FIG. 5 shows one preferred guiding roller and a lower runner for guiding a drag rope of the present invention.
Figure 6:
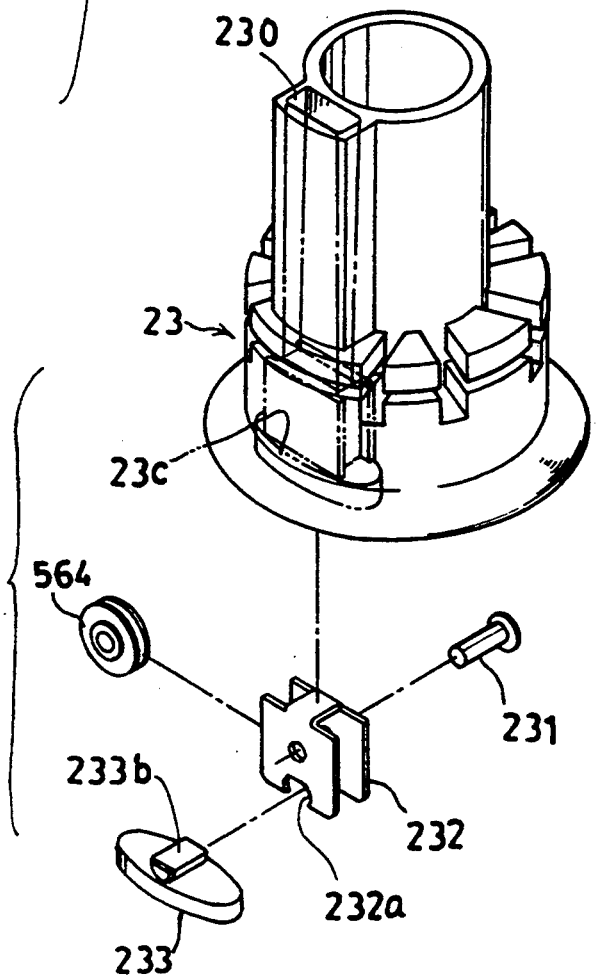
FIG. 6 shows another preferred guiding roller and the lower runner of the present invention.

The lower guiding roller 564 as shown in FIGS. 3–6 is rotatably mounted in a roller holder 232 embedded or fixed in the holder recess 23*a* in the lower runner 23 by a lower pivot 231 for guiding a rope section of the drag rope 56 through a lower rope passage 230 formed in the lower runner 23. The roller holder 232 for rotatably mounting lower guiding roller 564 may be sealably fixed in the lower runner 23 by a bottom cover 233 having a pair of locking stems 233*a* inserted into the stem hole 23*b* recessed in the lower runner 23 as shown in FIG. 5. Or, the bottom cover 233 may include a projection 233*b* on a central portion of the cover 233 to be engaged with a projection recess 232*a* in a bottom of the holder 232 for fixing the projection 233*b* into the projection recess 232*a* and for embedding the cover 233 into a cover recess 23*c* recessed in the lower runner 23 as shown in FIG. 6.

The anti-false operation safety means 57 includes: a collar 571 slidably disposed around a lower portion of the inner tube 11 and resiliently rested on a collar spring 57*a* retained in a grip hole 120 recessed in a central portion of the grip 12, a pair of retarding lugs 572 protruding downwardly from the collar 571 by a pair of connecting arms 572*a* defining a slot 572*b* between the two arms 572*a* for passing the lever 52 when upwardly rising the collar 571 and the lugs 572 when opening the umbrella as shown in FIG. 1, the pair of lugs 572 operatively positioned beyond the pair of arm members 545 of the sliding latch 54 to retard an inward depression of the lower button portion 513 of the push button 51 for preventing a false operation of the closing controller 53 when the central shaft means 1 is folded to lower the outer and middle tubes 14, 13 to allow a bottom end of each middle tube 13 and outer tube 14 for downwardly pressing the collar 571 and collar spring 57*a* downwardly for restoring the spring energy of the collar spring 57*a* as shown in FIG. 7 whereby the outer and middle tubes 14, 13 are locked by engaging the hook portion 522 with the hook holes 141,131, 111.

When opening the umbrella of the present invention as shown in FIG. 1, the upper button portion 512 of the push button 51 is depressed to force the depression portion 523 of the opening lever 52 to bias and disengage the hook portion 522 from the hook holes 141, 131, 111 formed in the tubes 14, 13, 11 of the shaft means 1 to release the opening spring 3, which is previously compressed when re-setting the umbrella for storing the elastic energy of the opening spring as shown in FIG. 4, to extend the tubes 14, 13, 11 and open the ribs of the rib assembly 2 for opening the umbrella. The closing springs 4 are also tensioned to store their restoring elastic energy by the opening operation of the umbrella as effected by the opening spring 3.

Figure 2:
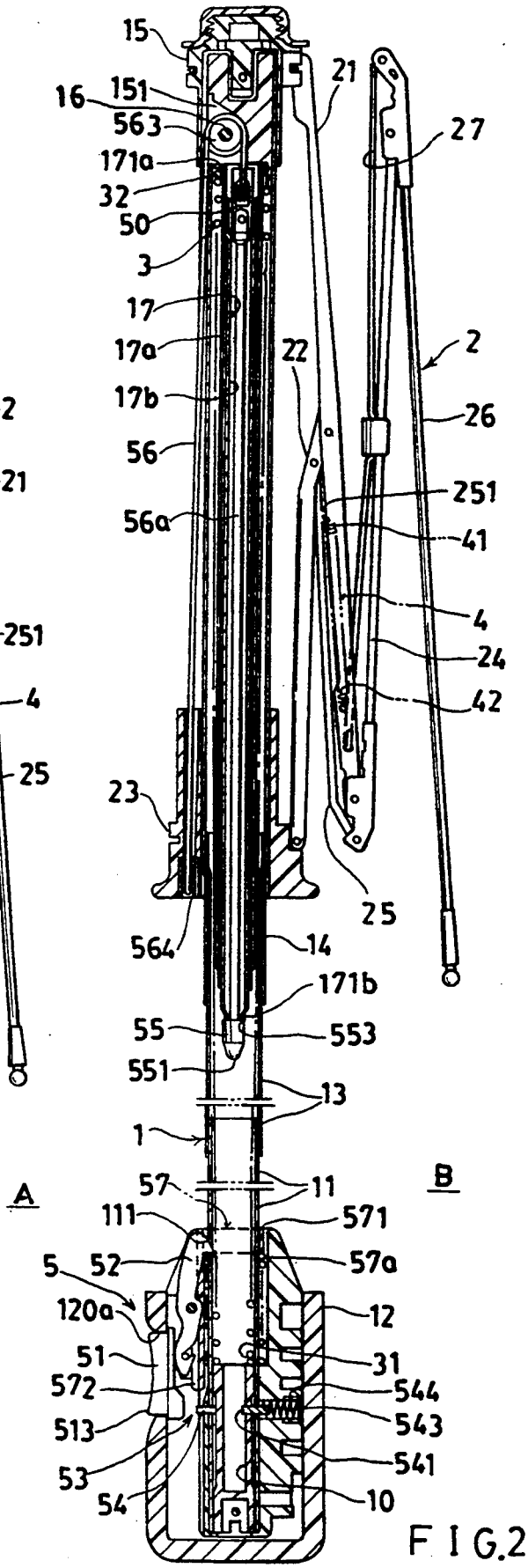
FIG. 2 is an illustration showing a closed umbrella of the present invention.

When closing the umbrella from FIG. 1 to FIG. 2, the lower button portion 513 of the push button 51 is depressed to force the sliding latch 54 of the closing controller 53 rearwardly (towards the second side B of shaft means 1) to disengage the locking head 55 from the tongue portion 541 of the sliding latch 54 to allow a downward movement of the runner 23 required for closing the umbrella, and the closing springs 4 will restore to lower the runner 23 to retract the ribs of the rib assembly 2 and fold the tubes 14, 13, 11 as shown in FIG. 2. The locking head 55 will then be raised to be stopped at a lower sleeve portion **171*b* of the sleeve set 17, and the coupling member 50 coupling the rod 56*a* and rope 56 will be stopped at the inner block 151 on a top portion of the outer tube 14. The two lugs 572 will be moved upwardly along with the collar 571 as upwardly urged by the collar spring 57*a* when opening the umbrella and raising the tubes 14, 13, thereby causing no obstruction for the inward depression of the lower button portion 513 of the button 51 for a normal closing operation of the umbrella (from FIG. 1 to FIG. 2**).

For re-setting the folded or closed umbrella to store an elastic energy of the opening spring 3, the grip 12 may be depressed towards a tip portion of the umbrella (FIG. 2 to FIG. 4) for compressing the spring 3 ready for next opening use.

The present invention may be used for an automatic umbrella having triple folds or multiple folds for a safer and more reliable operation of the umbrella.

Since this invention is provided with the safety means 57, once the upper button portion 512 of a folded umbrella (FIG. 4) is depressed to release the opening spring 3 and the umbrella cloth is not fully opened, a continuous depression of the lower button portion 513 will not depress the sliding latch 54 to prevent a suddenly releasing of the spring energy of the springs 3, 4 for preventing ejection of the shaft means 1 and preventing injury to a person.

We claim:

1. An automatic umbrella comprising:

a central shaft means (1) including: an inner tube (11), a grip (12) secured with the inner tube (11), a middle tube (13) slidably held on an outer and upper side of the inner tube (11), an outer tube (14) slidably held on an outer and upper side of the middle tube (13), an upper notch (15) secured on a top portion of the outer tube (14), and a central sleeve set (17) telescopically held within said inner, middle and outer tubes (11, 13, 14);

a rib assembly (2) including: a top rib (21) pivotally secured to the upper notch (15) of the central shaft means (1), an inner stretcher rib (22) pivotally secured to a lower runner (23) which is slidably held on the outer tube (14) and the inner stretcher rib (22) pivotally connected with the top rib (21), an intermediate rib (24) pivotally connected with the top rib (21) and pivotally connected with an intermediate connecting rod (25) with the intermediate connecting rod (25) pivotally secured to the inner stretcher rib (22), and a rear rib (26) pivotally connected with the intermediate rib (24) and pivotally connected with a spring rod (27) with the spring rod (27) pivotally connected with the top rib (21);

an opening spring (3) for opening an umbrella retained in said central shaft means (1) and slidably disposed about the central sleeve set (17);

a plurality of closing springs (4) respectively secured on said rib assembly (2) for operatively closing an umbrella from an opened state by an elastic energy stored when opening the umbrella; and a control means (5) including: a push button (51) resiliently mounted in the grip (12), an opening lever (52) pivotally mounted in an upper portion of the grip (12) and operatively depressed by an upper button portion (512) of the push button (51) for opening the umbrella, a closing controller (53) operatively depressible by a lower button portion (513) of the push button (51) for disengaging a locking head (55), which is secured with a drag rod (**56*a*) coupled to a drag rope (56) which is linked through the lower runner (23) to an upper portion of the outer tube (14), from a sliding latch (54) slidably held in the grip (12), thereby allowing each said closing spring (4) to be restored to release a pre-stored elastic energy for closing the umbrella from an opened state, and an anti-false operation safety means (57) formed in the grip (12) for normally shielding the closing controller (53) to prevent a false depression of the closing controller (53) after depressing the upper button portion (512**) and when the umbrella is not fully opened.

2. An automatic umbrella according to claim 1, wherein said central sleeve set (17) includes: an inner sleeve section (**17*b*), and an outer sleeve section (17*a*) telescopically coupled with the inner sleeve section (17*b*) having an uppermost sleeve portion (171*a*) of the outer sleeve section (17*a*) contiguous to an upper portion of the outer tube (14**).

3. An automatic umbrella according to claim 1, wherein each said closing spring (4) has an inner spring end (41) of the closing spring (4) secured to an inner connection portion (251) of the intermediate connecting rod (25) having a projection (**251*a*) protruding towards the top rib (21) and a hook hole (251*b*) eccentrically notched in the projection (251*a*) for engaging the inner spring end (41) formed with a hook, and an outer spring end (42) of the closing spring (4) secured to an outer rib portion of the top rib (21) by a pin (210**).

4. An automatic umbrella according to claim 1, wherein said opening lever (52) includes: a depression portion (523) formed on a lower portion of the opening lever (52) and resiliently held by a lever spring (524) retained in the grip to be operatively depressed by the upper button portion (512) of the push button (51) for disengaging a hook portion (522) of the opening lever (52) from a plurality of hook holes (141, 131, 111) of the outer, middle and inner tubes (14, 13, 11) for opening the umbrella as resiliently tensioned by the opening spring (3); the lever spring (524) resiliently urging the push button (51) outwardly to allow a shoulder portion (514) of the push button (51) to be normally retained on a periphery of a button hole (120*a*) formed in the grip (12) ready for a depression of said button (51).

5. An automatic umbrella according to claim 1, wherein said closing controller (53) includes: a sliding latch (54) having a tongue portion (541) engageable with a locking head (55) secured with a drag rod (56*a*) coupled to a drag rope (56), a pair of arm members (545) bifurcated from the tongue portion (541) and protruding forwardly towards the push button (51) to be operatively depressed by a depression block (513*a*) formed inside the lower button portion (513) of the push button (51) for closing an umbrella from an opened state, a latch spring (543) jacketed on a stem (542) protruding rearwardly from the tongue portion (541) towards a side of the shaft means (1) opposite to said button (51) to be resiliently retained on a plug (544) inserted in the grip (12) for normally urging the sliding latch (54) forwardly to be operatively depressed by the depression block (513*a*) of the lower button portion (513) of the push button (51), said anti-false operation safety means (57) operatively shielding the sliding latch (54) for preventing depression on said sliding latch (54).

6. An automatic umbrella according to claim 5, wherein said locking head (55) is generally cylindrical shaped and includes: a bottom ball portion (551) formed on a bottom portion of the locking head (55), and an annular shoulder portion (553) formed on an upper portion of the locking head (55) for connecting said drag rod (56*a*) and for engaging the tongue portion (541) of the sliding latch (54), said locking head (55) operatively downwardly moved to be rested on a lower sleeve (10) fixed in a lower portion of the inner tube (11) to be locked by the latch (54).

7. An automatic umbrella according to claim 5, wherein said drag rod (56*a*) has a lower rod end secured to the locking head (55) and an upper rod end coupled to the drag rope (56) by a coupling member (50), with the drag rod (56*a*) slidably held in an inner sleeve section (17*b*) of a central sleeve set (17) within a central shaft means (1) and having a length of the drag rod (56*a*) generally equal to a length of the central shaft means (1) when folded by closing the umbrella.

8. An automatic umbrella according to claim 7, wherein said coupling member (50) is secured with an upper rod end of the drag rod (56*a*) by a pin (502) and is formed with a rope cavity (501) in an upper portion of the coupling member (50) for securing a lower rope end (561) of the drag rope (56) in the rope cavity (501), said coupling member (50) limited by a lower sleeve end (171*b*) of the inner sleeve section (17*b*) of said shaft means (1) when opening the umbrella.

9. An automatic umbrella according to claim 8, wherein said drag rope (56) includes: the lower rope end (561) secured to the drag rod (56*a*) through the coupling member (50), an upper rope end (562) fixed to a top portion (152) of the outer tube (14) and in the upper notch (15), an upper guiding roller (563) rotatably mounted in the inner block (151) secured in a top portion of the outer tube (14) and in the upper notch (15) for slidably guiding the drag rope (56) from inside the outer tube (14) and the central sleeve set (17) telescopically held within the shaft means (1) by passing through the upper guiding roller (563), a lower guiding roller (564) and a rope passage (150) formed in the upper notch (15).

10. An automatic umbrella according to claim 9, wherein said lower guiding roller (564) is rotatably mounted in a roller holder (232) embedded in the holder recess (23*a*) in the lower runner (23) by a lower pivot (231) for guiding a rope section of the drag rope (56) through a lower rope passage (230) formed in the lower runner (23); said roller holder (232) for rotatably mounting the lower guiding roller (564) sealably fixed in the lower runner (23) by a bottom cover (233) having a pair of locking stems (233*a*) inserted into a pair of stem holes (23*b*) recessed in the lower runner (23).

11. An automatic umbrella according to claim 10, wherein said bottom cover (233) further includes a projection (233*b*) on a central portion of the cover (233) to be engaged with a projection recess (232*a*) in a bottom of the holder (232) for fixing the projection (233*b*) into the projection recess (232*a*) and for embedding the cover (233) into a cover recess (23*c*) recessed in the lower runner (23).

12. An automatic umbrella according to claim 5, wherein said anti-false operation safety means (57) includes: a collar (571) slidably disposed around a lower portion of the inner tube (11) and resiliently rested on a collar spring (57*a*) retained in a grip hole (120) recessed in a central portion of the grip (12), a pair of retarding lugs (572) protruding downwardly from the collar (571) by a pair of connecting arms (572*a*) defining a slot (572*b*) between the two arms (572*a*) for passing the opening lever (52) when upwardly rising the collar (571) and the lugs (572) when opening the umbrella, the pair of lugs (572) movably positioning beyond the pair of arm members (545) of the sliding latch (54) for retarding an inward depression of the lower button portion (513) of the push button (51) for preventing a false operation of the closing controller (53) when the central shaft means (1) is folded to lower the outer and middle tubes (14, 13) to allow a bottom end of each said middle tube (13) and outer tube (14) for downwardly pressing the collar (571) and collar spring (57*a*) downwardly for restoring a spring energy of the collar spring (57*a*) whereby the outer and middle tubes (14, 13) are locked.

* * * * *